US005443541A

United States Patent [19]

St. Louis

[11] Patent Number: 5,443,541

[45] Date of Patent: Aug. 22, 1995

[54] DUAL ELEMENT ELECTRICAL CLOTHER DRYER WITH SINGLE ELEMENT INTERRUPT CIRCUIT

[76] Inventor: Robert M. St. Louis, 8980 Rochette,, St. Leonard, Quebec, Canada

[21] Appl. No.: 135,182

[22] Filed: Sep. 28, 1993

[30] Foreign Application Priority Data

Mar. 18, 1993 [CA] Canada ..... 2091940

[51] Int. Cl.[6] ..... F26B 3/00

[52] U.S. Cl. ..... 34/486; 34/491; 34/549; 34/553; 34/562

[58] Field of Search ..... 34/549–555, 34/493, 496, 497, 487, 491, 486, 543, 562, 565

[56] References Cited

U.S. PATENT DOCUMENTS 4,713,894 12/1987 Roth et al. ..... 34/493
5,245,764 9/1993 Sung ..... 34/550
5,301,438 4/1994 Tanaka et al. ..... 34/550

FOREIGN PATENT DOCUMENTS 817579 7/1969 Canada .
972092 7/1975 Canada .
995452 8/1976 Canada .
1241190 8/1988 Canada .
1281183 3/1991 Canada .
1293762 12/1991 Canada .

*Primary Examiner*—Denise L. Gromada

[57] ABSTRACT

This invention relates to a clothes dryer which can successfully cope with operation when the air circulation path is partially blocked. The dryer is of a type having dual heating elements and during conditions where blocking exists, the heat generation is reduced by disconnecting one of the heating elements while air is circulated thru the dryer.

5 Claims, 3 Drawing Sheets

DUAL ELEMENT ELECTRICAL CLOTHER DRYER WITH SINGLE ELEMENT INTERRUPT CIRCUIT

This invention relates to a control circuit for an electric clothes dryer which normally employs dual electric heating elements for heating the air which is subsequently drawn through the rotating drum of the dryer. The usual control for electric clothes dryers uses a number of temperature sensitive devices mounted in strategic places in the air flow path to constantly monitor the temperature of the airstream at each strategic location, and when the switching temperature of the temperature sensing devices is reached the flow of electric energy to the dryer heater is interrupted. Usually, during this time, the drum continues to rotate and the air blower continues to draw air through the dryer until the temperature of the air drops sufficiently to cause the temperature sensing device which previously opened, to close and re-energize the dryer heater to again begin the air heating cycle over again. Most of the present day dryers include an automatic cycle which is designed to terminate the cycle automatically when the clothes are dried in the automatic cycle. During the time that the energy to the heater is interrupted, it is not unusual to have a dryer timing device advance toward the end of its timing cycle. This process is repeated again and again each time that the temperature sensor is activated with the end result being that as the clothes in the dryer drum are approaching the desired degree of dryness and the timing device is approaching its final time out and shut down of the dryer occurs just as the clothes have reached the desired degree of "dryness". (One of the temperature sensors which has a temperature operating point substantially above the others serves as a safety device and once this particular sensor trips, the operation of the dryer is terminated, even the blower motor is shut off.)

The above drying cycle has been incorporated by the manufacturers of domestic electric clothes dryers for the convenience of the operator. Some deviations in the operation of the control circuit are possible but the underlying philosophy of control remains the same, that is, the timer advances only when the flow of electric power to the dryer heater is interrupted; the timer motor serves to integrate those periods when power to the heater is interrupted and stop the drying process when a predetermined amount of time has elapsed. The operator is permitted to control the level of dryness by changing a control which increases or decreases the integrated time period that the timer motor must integrate before the drying process is stopped.

This method of control is to be differentiated from the method of control where the overall drying time is selected and set by the operator at the beginning of the drying operation and the timing device continuously operates to advance to the original predetermined timed setting whereupon the drying operation is terminated. This method of drying sees a constant, continuous advance in the timer mechanism during the drying operation, and the temperature sensing devices are continually sensing air temperature at various locations in the air stream and the interruption of the power to the dryer heater does not have any effect on the advance or stopping of the timing device in the dryer.

Thus it is the former method of control to which this invention is directed and this improvement is useful only with electric dryers equipped with a pair of heating elements, which may be separately energized. The invention will found to be most useful in dual element heater dryers in which some impediment to the air flow path is present, ie the exhaust ducting is partially obstructed, the lint filter is partially blocked or some other problem has arisen in the air stream which partially obstructs the normal air flow.

This invention seeks to improve the performance of such driers by interrupting the electricity flow to one of the heating elements, usually the outer coil, once a predetermined temperature at a preselected location in the dryer has been reached. During the time that the flow of electricity to the single element is interrupted, the other heating element of the pair continues to operate at full wattage so that heat is still added to the air stream, albeit at a reduced rate. However, the timing motor is prevented from advancing during this period because of the circuitry chosen to prevent such timing advancement under this reduced temperature drying condition.

Thus the dryer continues to operate although the heat introduced into the air passing through the dryer has been substantially reduced and the timer has not advanced. When the sensor which interrupted the electricity flow to the single element subsequently cools to its closing state, the de-energized heating element is again energized and again full heating wattage is applied to the combined elements thus adding the normal heat to the moving air stream and the process repeats until the temperature sensor at the outlet of the drum assumes control of the heating elements (this temperature sensor is usually used to control the drying process) and upon interruption of power to the dual elements by this sensor, the timing motor advances toward its ultimate end at which time the drying cycle is completed.

SUMMARY OF THE INVENTION

This invention relates to the power interruption of one of the heating elements of a dual element electric clothes dryer during a drying operation, the timing motor being held from advancing during this time.

DESCRIPTION OF THE PREFERRED EMBODIMENT

Figure 1:
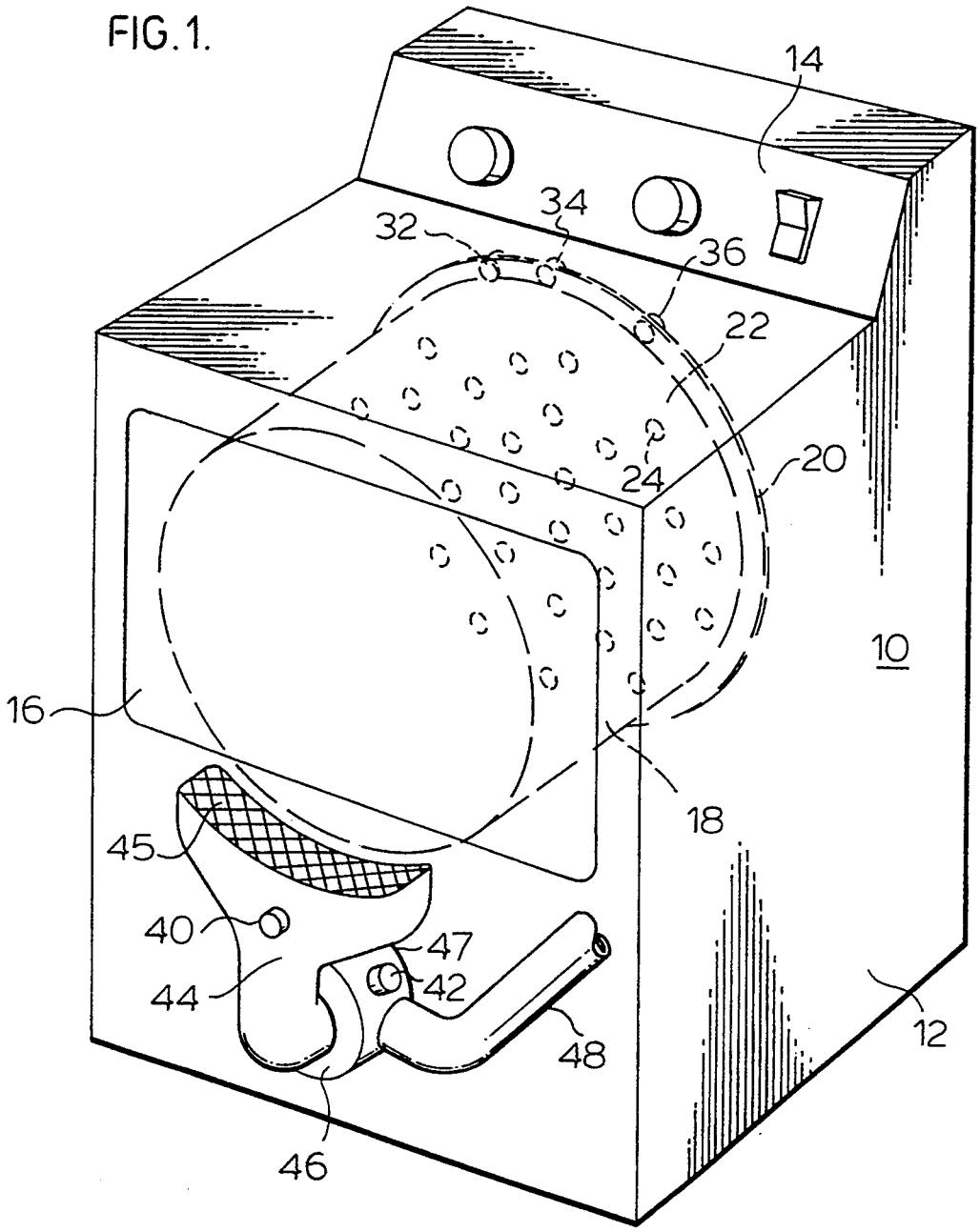
FIG. 1 is a partial perspective of an electric clothes dryer of this invention.

Referring now to the drawings and FIG. 1 in particular, a domestic clothes dryer 10 is shown.

Dryer 10 has a cabinet or housing 12 on which is mounted a control panel 14 which allows the user to select various drying modes and degrees of dryness of the clothes undergoing drying. Cabinet 12 has a door 16 mounted on the front panel to allow access to the drum 18. Drum 18 is mounted in cabinet 12 so as to allow for rotation therein.

Figure 2:
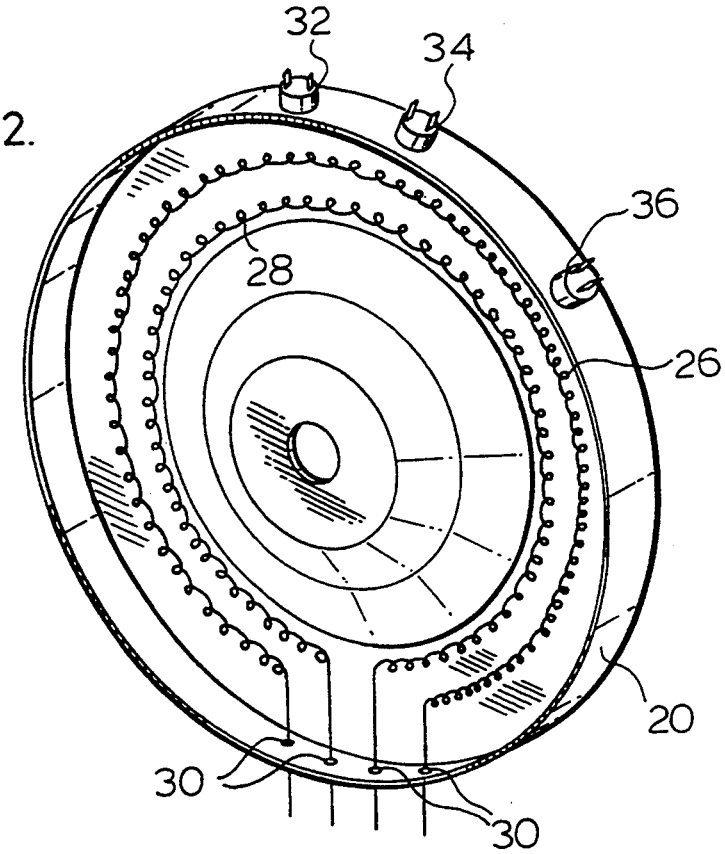
FIG. 2 is a view of the diffuser showing the heating device of the dryer of FIG. 1.

Drum 18 is mounted within the cabinet 12 so that the rear of the drum 18 is substantially surrounded by a diffuser 20, shown in more detail in FIG. 2. The drum 18 is provided with a flat disc shaped member 22 at the rear thereof which contains a plurality of apertures such as 24 for the passage of drying air there through.

The diffuser 20 of the dryer 10 provides a convenient method of mounting a pair of electrical heating elements 26 and 28 on insulators mounted in the diffuser. These elements are standard heating elements and in the dryer illustrated, the elements in this instance being capable of separate electrical energization. The elements 26 and 28 pass through insulators such as those shown at 30 in the diffuser 20. The diffuser is made to mate with the revolving drum so that there is good communication between the drum and the diffuser for the hot air steam.

Three temperature sensors 32, 34 and 36 are shown mounted on the top of the diffuser 20. Two of these thermostats 32 and 34 are designed to open before the temperature of the air entering the clothes drum reaches a point that might damage the clothes being dried. The third temperature sensor 36 has a higher temperature rating and would be generally regarded as an ultimate safety device rather than a controlling device.

Figure 3:
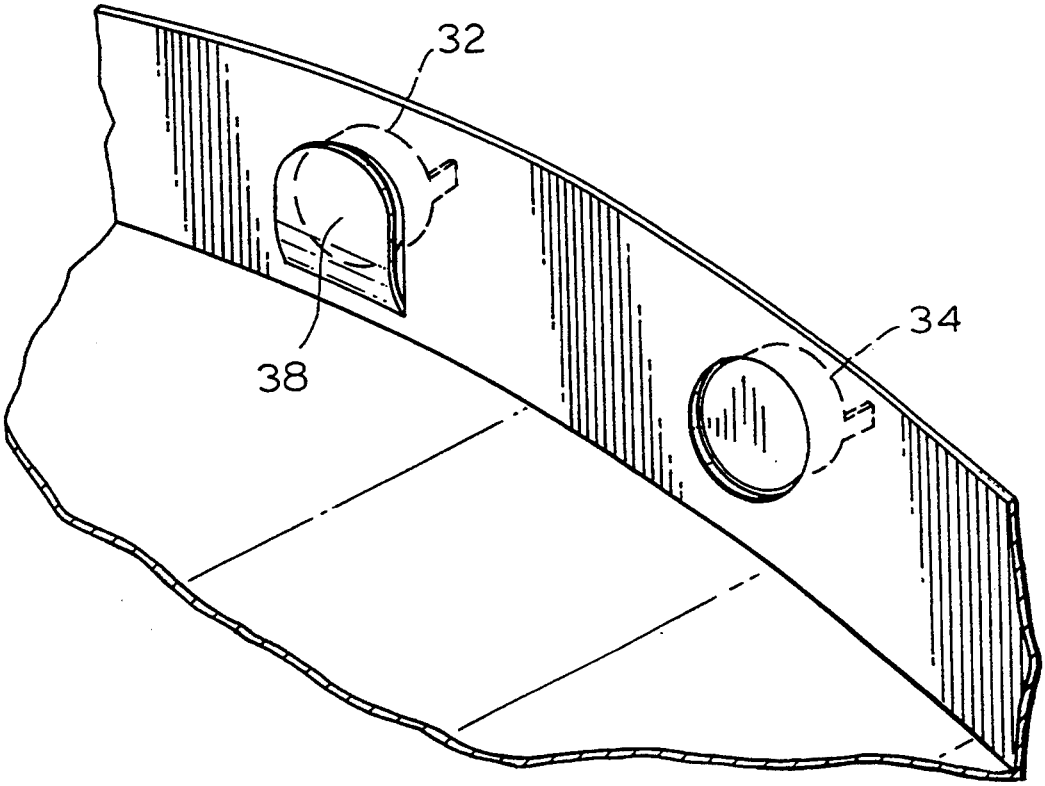
FIG. 3 is an enlarged view showing the mounting of the thermostatic devices in the diffuser of FIG. 2.

As previously stated, the thermostatic devices 32 and 34 will have operating characteristics and be mounted in a different manner on diffuser 20. Referring to FIG. 3, it will be seen that thermostat 34 is mounted in diffuser 20 in the usual manner with the temperature sensing head exposed completely to the airflow in the diffuser. Thermostat 32 on the other hand is somewhat shielded from the airflow in the diffuser by the fact that only part of the temperature sensing head is exposed to the atmosphere inside the diffuser. In this instance, a "strap" of the metal 38 from diffuser 20 remains beneath the thermostat 32 to shield the device and delay its reaction. Thus, under changing temperature conditions thermostat 32 will have a delayed reaction compared to thermostat 34.

It would also be possible to utilize two thermostats for operation of this invention whose temperature ratings are slightly different ie device 34 opening at say 190° F. and device 32 opening at 210° F. However for convenience in manufacturing it is simpler to use two thermostats of the same temperature operating characteristics. Not only do the devices cost less in quantity, but the problem of accidentally interchanging two devices of different ratings during manufacture is eliminated.

Two additional temperature sensors or thermostats are located at or near the front of the cabinet so as to sample the temperature of the air stream as it leaves the rotating drum. These are sensors 40 and 42 which essentially control the drying process. Temperature sensor 42 has a higher temperature activation than sensor 40.

A housing 44 is mounted so as to be in airflow communication with drum 20. A lint filter 45 is shown for trapping lint just as the air enters housing 44. Air is drawn from housing 44 into blower housing 46, the blower being driven by motor 47 and the air leaving blower 46 exits the dryer via pipe or duct 48.

Figure 4:
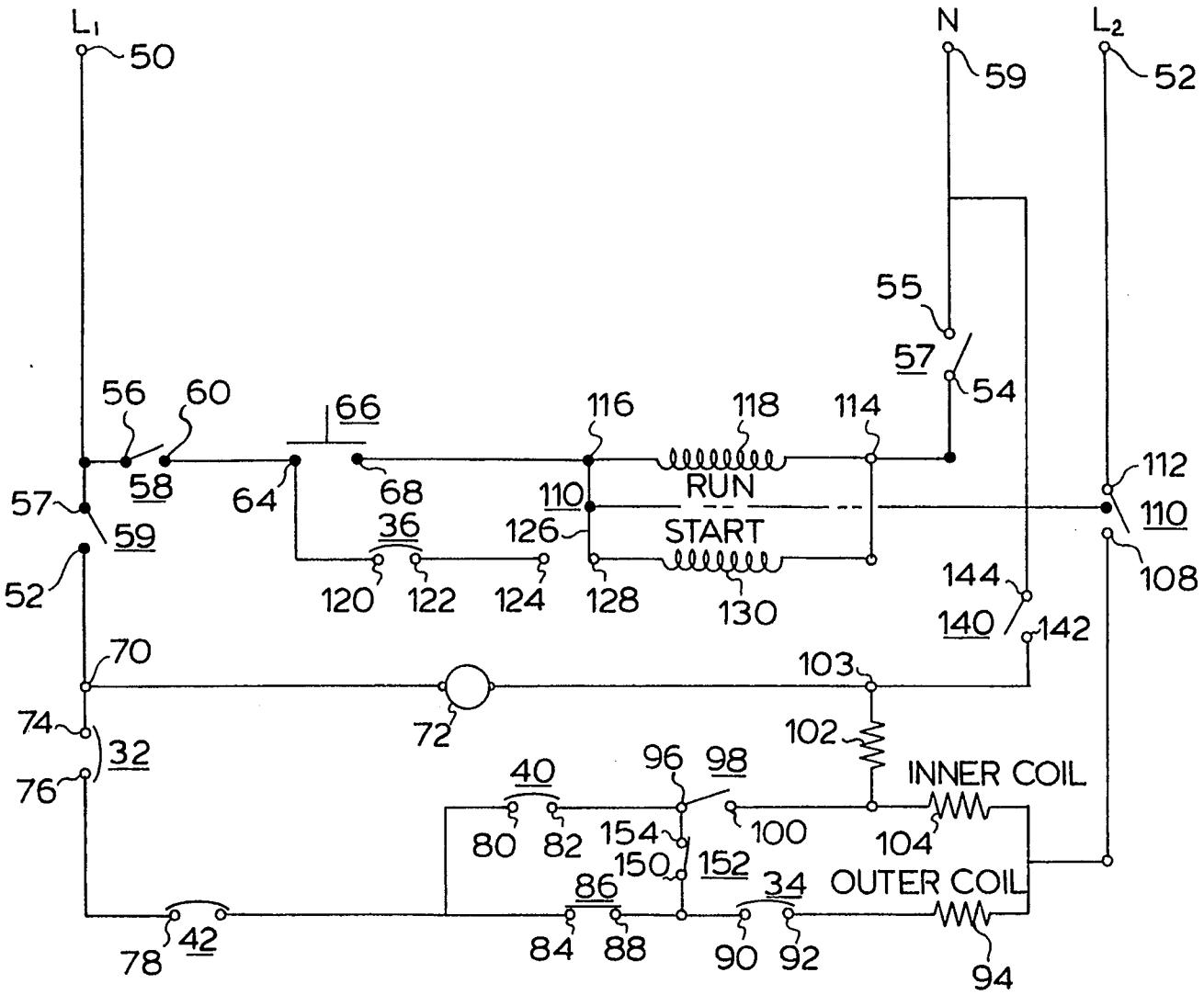
FIG. 4 is a circuit diagram utilized by this invention.

The basic control circuit is shown in FIG. 4. Power is fed to the two terminals 50 and 52 designated as $L_1$ and $L_2$respectively. The neutral terminal is shown at 59. Terminal 50 is connected to one pole 56 of timer motor control switch 58 and to terminal 57 of timer motor control switch 59. The other pole 60 of switch 58 is connected to terminal 64, of start switch 66. The other pole 62 of timer switch 59 is connected to terminal 70. Terminal 70 is connected to timer motor 72 and pole 74 of thermostat 32. The other pole 76 of thermostat 32 is connected to pole 78 of thermostat 42. The other pole of thermostat 42 is connected to pole 80 of thermostat 40 and pole 84 of switch 86. Pole 88 of switch 86 is connected to pole 90 of thermostat 34 and pole 92 of thermostat 34 is connected to one side of outer heating coil 94.

The other pole 82 of thermostat 40 is connected to pole 96 of switch 98 and terminal 154 of switch 152. Pole 100 of switch 98 is connected to one side of resistor 102, and to one end of inner heating coil 104. Pole 150 of switch 152 is connected to terminal 88 of switch 86 and terminal 90 of thermostat 34.

Heating coils 94 and 104 are connected to one pole 108 of centrifugal switch 110. The other pole 112 of switch 110 is connected to terminal 52 of $L_2$.

Timer motor 72 is connected to resistor 102 and terminal 142 of switch 140. Terminal 144 of switch 140 is connected to the neutral terminal 59.

Pole 68 of start switch 66 is connected to pole 116 of centrifugal switch 110 which in turn is connected to "run" winding 118 of the blower motor 44 shown in FIG. 1. The other end of run winding 118 is connected to terminal 114 which is connected to terminal 54 of switch 57.

Pole 64 of start switch 66 is connected to pole 120 of high limit thermostat 36 (located on the diffuser). Pole 122 of thermostat 36 is connected to pole 124 of centrifugal switch 110. The blade 126 of centrifugal switch 110 is shown in its "start" position, ie bridging poles 116 and 128. Pole 128 is connected to "start" winding 130 of motor 47. The other end of start winding 130 is connected to terminal 114 which is connected to terminal 54 of door switch 57. The other terminal 55 of door switch 57 is connected to neutral terminal 59.

Basically the circuit functions as follows:

Control timer is set by the operator to a setting calculated to give a predetermined desired degree of "dryness" to the clothes in dryer drum 18 at the end of the drying cycle. The other variable set by the operator is the type of fabrics, whether "Wash and Wear" or "Regular Drying" is desired. This is accomplished by means of switches 86 and 98 and 152 (which are coupled) and in the circuit shown in FIG. 4 control will resort to thermostat 40 which has the lower temperature operating point (as compared to the other control thermostat 42).

With the control timer 58 and 59 set, contacts 56 and 60 plus contact 57 and 62 are closed, and control temperature selected, the operator depresses the "start" button on switch 66 and the windings 118 and 130 are energized and motor 47 begins to run. As the motor gains speed centrifugal switch 110 snaps to the alternate state closing contacts 116, 124 and 108 and 112. The operator may now allow the start switch 66 to return to its unbridged position opening contacts 64 and 68. Run winding 118 is now energized through high temperature thermostat 36 and switch blade 126 of switch 110.

Similarly, current for the two heating elements is supplied via control timer, switch 59, safety thermostat 32, (located on diffuser) high temperature drum outlet temperature sensor 42, low temperature drum outlet temperature sensor 40, switch 98 and to coil 104 also from sensor 42 to switch 86, sensor 34 to coil 94. It will be noted that thermostat 34 carries current from switch 86 to coil 94, and this thermostat which would not be present in the prior art driers, forms the basis for this invention. Thermostats 32 and 34 are located quite close to each other on the diffuser and their characteristics are chosen to be identical but thermostat 32 is shielded and requires a longer time period to respond than does thermostat 34.

The timer motor will not advance as long as the heater 104 is energized because resistor 102 maintains a potential of $L_1$ on terminal 103.

As the clothes begin to dry, the temperature of the air exiting the drum begins to increase and thermostat 42 controls the energization of coils 94 and 104. As the temperature of the air exiting the drum increases (indicating that the clothes are drying), the thermostat 40 opens but when normal (high) drying temperature has been chosen by operator, switch 86 and 152 will keep passing current to both heater coils 94 and 104. As temperature of air exiting the drum keeps increasing to the point where sensor 42 opens and stops current flow to both coils, the potential at terminal 103 approaches that of $L_2$ and timer motor 72 beings to advance the timer.

When the air exiting the drum cools somewhat, thermostat 42 closes and the advance of the timer ceases and the coils 94 and 104 are energized again. This cycle repeats until the timer times out and switch 59 opens then current flow to heater coils ceases and timer motor runs continuously to the point where switch 58 opens. At that point, main motor 47 stops and the dryer stops.

If thermostat 34 is omitted from the circuit as in prior art models, assuming terminals 90 and 92 are permanently bridged, if an obstruction occurs in the air flow path, the temperature in the diffuser increases and the thermostat 32 (which in prior art devices would be unshielded) opens (insufficient hot air arriving at thermostat 40 to cause it to open) and timer 72 advances and the clothes in the drum are not drying because of the obstruction in the air stream. If the obstruction is continuous, and thermostat 32 continues to open and close, the clothes are not being dried, but the timer is advancing each time thermostat 32 opens. The end result is that the timer eventually times out and the clothes in the drum are still wet, because the timer was advancing because the diffuser was subjected to overheat and thermostat 32 kept opening and closing.

In order to overcome this deficiency, thermostat 34 will provide a solution. Thermostat 34 is mounted in diffuser in the same general location as thermostat 32, but is more temperature sensitive because of the absence of shield 38. If in the presence of an obstruction in the air flow stream in the dryer or in the exhaust ducting, connected to the dryer 10, when overheating occurs in the diffuser 20, thermostat 34 will open before thermostat 32, disconnecting the outer heating coil 94 from terminal 50 of $L_1$allowing only about half the previous heat to be added to the drum 18 and diffuser 20. During this time, reduced wattage allows the drying operation to continue, and the timer is not allowed to advance because terminal 103 is maintained at the potential of $L_1$. Thus the thermostat 34 continues to cycle on and off until the clothes begin to dry at which time the air leaving the drum begins to heat up and the thermostat 42 begins to assume control as the temperature of the air leaving the drum rises to a level to cause thermostat 42 to open. When thermostat 42 opens, the timer begins to advance to the end of its cycle.

When thermostat 42 assumes control, it will be found that thermostat 34 may continue to cycle depending on the temperature rise in the diffuser 20. However, the timer 72 will only advance when any of the thermostats 32 or 42 open. All of these thermostats only serve to interrupt the power to the dryer heating elements 94 and 104; they do not halt operation of the dryer, thermostat 36 which is a safely device of a high temperature rating serves to stop the entire dryer operation should its contacts open.

Thus, it will be seen that when an obstruction occurs in the air flow path of the clothes dryer that the temperature in the diffuser increases because the heat generated by the dryer heating elements is not being transferred to the damp or wet clothes in the drum. In prior art circuits, the thermostat in the diffuser region would be designed to interrupt the total power to heating elements and the timer would advance to its time out. Meanwhile, the degree of moisture removal from the set clothes in the drum was insignificant.

This invention keeps up the drying operation, albeit at a reduced rate while such problems exist, and the timer advance is held in abeyance while the partial energization of the dryer heating elements occurs.

If the obstruction in air flow is too high, even if sensor 34 opens and lets only one coil heating, the temperature could still keep increasing in diffuser to the point where sensor 32 would open. The timer motor would then advance to the off position. Sensor 32 and 34 are calibrated so that this condition would only happen in very high air flow restrictions and at these restrictions, it is acceptable to stop with wet clothes. It is hoped that then the operator will notice the problem and inspect and correct air blockage.

Various alternatives will be obvious to those skilled in the art, but applicant wishes to be limited only the scope of the following claims.

I claim:

1. A control circuit for a domestic electric clothes dryer, having a cabinet, a rotating clothes drum mounted in said cabinet, a blower for moving air through said drum and through an exhaust duct connected to said blower, a diffuser member mounted adjacent said drum for housing a heating device, therein for heating air prior to passage through said drum, a timer for timing a preselected operation in said dryer, said control circuit sensing the temperature of the hot air entering the clothes drum, as well as the temperature of the air leaving the drum, said control circuit de-energizing said heating device when the hot air entering the clothes drum reaches a first predetermined temperature, said control circuit also de-energizing said heating device when the air leaving the drum reaches a second predetermined temperature, said control circuit partially de-energizing said heating device when the hot air entering said drum reaches a third predetermined temperature which is slightly lower than said first predetermined temperature, said timer being advanced toward its expiry during periods when said heating device is de-energized, but not during periods when said heating device is partially de-energized.

2. A control circuit for an electric clothes dryer of the type wherein clothes to be dried are deposited into a rotating drum in said dryer through which hot air is passed, said hot air being heated by a pair of electric heating elements in a space adjacent said drum, said control circuit comprising at least:

a first thermostatic means for sampling the temperature of the air entering the drum, and a second thermostatic means for sampling the temperature of the air entering said drum, and a third thermostatic means for sampling the temperature of the air leaving the drum, a timing means for timing the intervals when said second or third thermostatic means is open, said second and third thermostatic means each having predetermined temperature opening characteristics such that said first thermostatic means will open at a slightly lower temperature than said second thermostatic means, said second and third thermostatic means being connected into said control circuit in such a manner that both elements of said dryer are de-energized upon the opening of said second or third thermostatic means, and only one element of the pair of heating elements is de-energized when said first thermostatic means is opened, said timing means being advanced toward its expiry setting only during periods when said second or third thermostatic means is open.

3. A method of operating a domestic clothes dryer of the type wherein a blower causes the drying air to be circulated through the dryer in a predetermined path comprising at least:

a housing containing a heating device, a rotating clothes drum, a filter, a blower, an exhaust duct, wherein the path may at times be subject to restrictions tending to impede the circulation of drying air, and wherein a timing device is used to control the length of time that the dryer operates, and wherein a control circuit senses the temperature of the drying air in said housing, as well as the temperature of the drying air at some suitable location after the drying air has left the rotating drum, said control circuit having a first switching means to sense a first predetermined temperature in said housing and a second switching means to sense a second predetermined temperature in said housing which is slightly above said first temperature, and third switching means to sense a third predetermined temperature of the drying air at said some suitable location which is less than either of said first or second predetermined temperature, said control circuit energizing said timing device, and de-energizing said heating device during periods when either said first or third switching means reaches the first and third predetermined temperatures respectively, so that said timing device advances toward its timed expiration during this time, said control circuit partially de-energizing said heating device during periods when said second switching means senses said second predetermined temperature in said housing, and said control circuit also operates to prevent energization of said timing means during such periods when said second temperature is sensed by said second switching means.

4. A method of operating a domestic clothes dryer under a variety of conditions where the air flow path may be restricted in varying degrees, said dryer being of the type where an air blower is used to circulate drying air in a predetermined path within said dryer, containment means for holding clothes to be dried, control means responsive to signals produced in temperature sensing devices located at various locations in said dryer, heat generation means located within said dryer for heating air before it enters said containment vessel, a first temperature sensing means to sense a first predetermined temperature of the air entering said containment means and produce a first signal when said first predetermined temperature is reached, a second temperature sensor to sense a second predetermined temperature which is slightly lower than said first predetermined temperature of the air entering said containment means, said second sensor producing a second signal when said second predetermined temperature is reached, third temperature sensing means placed in a suitable location to sense the temperature of the air leaving the containment means, said third temperature sensing means sensing a third predetermined temperature and producing a third signal when said third predetermined temperature is reached, said control means responsive to the presence of said first and third signals to interrupt heat generation means in the dryer and energize a timing means to begin to move the timing means toward its expiry, said control means responsive to the presence of said second signal to reduce the generation of heat in the dryer by a predetermined amount, whilst the drying operation continues.

5. A method of operating a clothes dryer wherein a blower cause drying air to circulate in a predetermined path within said dryer, sensing means to sense the temperature of the drying air entering and leaving the containment vessel wherein the clothes to be dried are contained, control means to prevent the generation of heat in said dryer during periods when the sensing means has sensed that temperature of the air entering and leaving said containment vessel exceeds predetermined entrance or exit temperatures, during which period a timing device is actuated to move toward its expiration, said control means being arranged so that during normal air flow conditions, the exit temperature of the drying air is used to activate said timing device and prevent the generation of heat in the dryer, and during severe air blockage conditions when the flow of drying air is very restricted, the temperature of the air entering the containment vessel will rise and the control means will be responsive to said inlet temperature, the control means having an alternate sensing means for the detection of a second entrance air temperature slightly below said predetermined entrance temperature, said alternate sensing means providing a signal to said control means when said second entrance temperature is reached, to diminish the generation of heat in said dryer to a predetermined level, but not to activate said timing device during the presence of the signal from said alternate sensing means.

* * * * *